US010494207B2

(12) United States Patent
Niikura

(10) Patent No.: US 10,494,207 B2
(45) Date of Patent: Dec. 3, 2019

(54) SHEET FEEDING DEVICE AND IMAGE FORMING SYSTEM

(71) Applicant: Yasuo Niikura, Kanagawa (JP)

(72) Inventor: Yasuo Niikura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/989,965

(22) Filed: May 25, 2018

(65) Prior Publication Data

US 2018/0346265 A1 Dec. 6, 2018

(30) Foreign Application Priority Data

Jun. 6, 2017 (JP) ..... 2017-111842
Mar. 23, 2018 (JP) ..... 2018-055960

(51) Int. Cl.

| | |
|---|---|
| ***B65H 1/14*** | (2006.01) |
| ***B65H 1/26*** | (2006.01) |
| ***B65H 3/12*** | (2006.01) |
| ***B65H 1/04*** | (2006.01) |

(52) U.S. Cl.

CPC ..... *B65H 1/14* (2013.01); *B65H 1/04* (2013.01); *B65H 1/26* (2013.01); *B65H 3/128* (2013.01); *B65H 2405/112* (2013.01); *B65H 2405/11161* (2013.01); *B65H 2405/15* (2013.01); *B65H 2701/1916* (2013.01)

(58) Field of Classification Search

CPC ... B65H 1/04; B65H 1/12; B65H 1/14; B65H 1/18; B65H 1/20; B65H 1/26; B65H 2405/1116; B65H 2405/1117; B65H 2405/211

USPC ..... 271/2, 148

See application file for complete search history.

(56) References Cited

U.S. PATENT DOCUMENTS

| | | | |
|---|---|---|---|
| 9,359,157 | B2 | 6/2016 | Niikura et al. |
| 9,359,158 | B2 | 6/2016 | Hino et al. |
| 9,428,352 | B2 | 8/2016 | Niikura et al. |
| 9,540,193 | B2 | 1/2017 | Fukumoto et al. |
| 9,725,265 | B2 | 8/2017 | Hashimoto et al. |
| 9,796,552 | B2 | 10/2017 | Fukumoto et al. |
| 9,802,775 | B2 | 10/2017 | Hashimoto et al. |
| 10,017,340 | B2 | 7/2018 | Matsuoka et al. |
| 10,017,342 | B2 | 7/2018 | Okutsu et al. |
| 10,065,824 | B2 | 9/2018 | Edo et al. |

(Continued)

FOREIGN PATENT DOCUMENTS

| | | |
|---|---|---|
| EP | 3 034 443 A1 | 6/2016 |
| JP | 10-35901 A | 2/1998 |

(Continued)

*Primary Examiner* — David H Bollinger
(74) *Attorney, Agent, or Firm* — Oblon, McClelland, Maier & Neustadt, L.L.P.

(57) ABSTRACT

A sheet feeding device comprises a bottom plate, an auxiliary tray and a tilt table. The bottom plate is configured to move along a vertical axis. The auxiliary tray is disposed on the bottom plate. The tilt table includes a lower table disposed on the bottom plate, an upper table rotatably connected to the lower table at one end of the upper table by a pivot, and a resilient member disposed between the upper table and the lower table, the resilient member configured to press the upper table upward. The auxiliary tray and the upper table are configured to receive and hold sheets in a stack.

19 Claims, 22 Drawing Sheets

(56) References Cited

U.S. PATENT DOCUMENTS

| | | | | |
|---|---|---|---|---|
| 2007/0120318 | A1* | 5/2007 | Moore | B65H 1/04<br>271/148 |
| 2017/0174453 | A1 | 6/2017 | Akai et al. | |
| 2017/0174458 | A1 | 6/2017 | Takano et al. | |

FOREIGN PATENT DOCUMENTS

| | | | |
|---|---|---|---|
| JP | H10-35901 | A | 2/1998 |
| JP | 2013-155003 | A | 8/2013 |
| JP | 2016-137956 | A | 8/2016 |

* cited by examiner

SHEET FEEDING DEVICE AND IMAGE FORMING SYSTEM

CROSS-REFERENCE TO RELATED APPLICATIONS

This patent application is based on and claims priority pursuant to 35 U.S.C. § 119(a) to Japanese Patent Application Nos. 2017-111842, filed on Jun. 6, 2017, and 2018-055960, filed on Mar. 23, 2018, in the Japan Patent Office, the entire contents of which are incorporated herein by reference.

BACKGROUND

Technical Field

The present disclosure relates to a sheet feeding device and an image forming system.

Related Art

A large capacity tray (i.e., LCT) is known as a recording medium storage device for stacking recording media (e.g., sheets) to be supplied to an image forming apparatus. The recording medium storage device stacks the recording medium on the bottom plate and regulates the end portion of the recording medium by the side fence and the end fence.

Plain paper, thin paper, thick paper, overhead projector (OHP) sheet and label paper are stacked in the recording medium storage device. In addition, a pocket-shaped sheet having uneven thickness such as an envelope, a bag, a medicine bag is also stacked in the recording medium storage device.

Because the number of overlapping sheets is different depends on the position of the pocket-shaped sheet, a height of the pocket-shaped sheet stacked on the bottom plate is different on the four sides thereof. As pocket-shaped sheets are piled up on the bottom plate, a bottom side of the pocket-shaped sheet is particularly overlapped. Thereby, with respect to a stacking height of the pocket-shaped sheets, the bottom side of the pocket-shaped sheet is higher than the other sides thereof.

The stacking height of a stacked pocket-shaped sheet on the end fence side opposite to a sheet feeding port is low because a higher side of the stacked pocket-shaped sheets is placed toward the sheet feeding port in general. For this reason, if there is a large height difference in an uppermost surface of the stacked pocket-shaped sheets, it causes a sheet jam such as non-feeding and multiple feeding when a sheet feeding is performed by an air suction or a friction separation.

Therefore, the uppermost surface of the stacked pocket-shaped sheets is required to reduce a height difference.

SUMMARY

A first aspect of the present disclosure provides a novel sheet feeding device. A sheet feeding device in accordance with the present disclosure includes a bottom plate, an auxiliary tray and a tilt table. The bottom plate is configured to move along a vertical axis. The auxiliary tray is disposed on the bottom plate. The tilt table includes a lower table disposed on the bottom plate, an upper table rotatably connected to the lower table at one end of the upper table by a pivot, and a resilient member disposed between the upper table and the lower table, the resilient member configured to press the upper table upward. The auxiliary tray and the upper table are configured to receive and hold sheets in a stack.

A second aspect of the present disclosure provides a novel image forming system. An image forming system in accordance with the present disclosure includes the sheet feeding device described in the first aspect of the present disclosure and a printer.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

In describing the drawings, specific terminology is employed for the sake of clarity. However, the present disclosure is not intended to be limited to the specific terminology so selected and it is to be understood that each specific element includes all technical equivalents that operate in a similar manner and achieve similar results.

Although the present disclosure is described with technical limitations with reference to the attached drawings, such description is not intended to limit the scope of the disclosure and all of the components or elements described in this disclosure are not necessarily indispensable.

In the following description, a sheet having uneven thickness is described as the sheet. For example, the sheet is an envelope as a pocket-shaped sheet. The pocket-shaped sheet may be a bag or a medicine bag. If an image or a character is recorded on the sheet to be fed, the sheet is also referred to as a recording medium. In the following, it is described using envelope as an example of the sheet.

Figure 1:
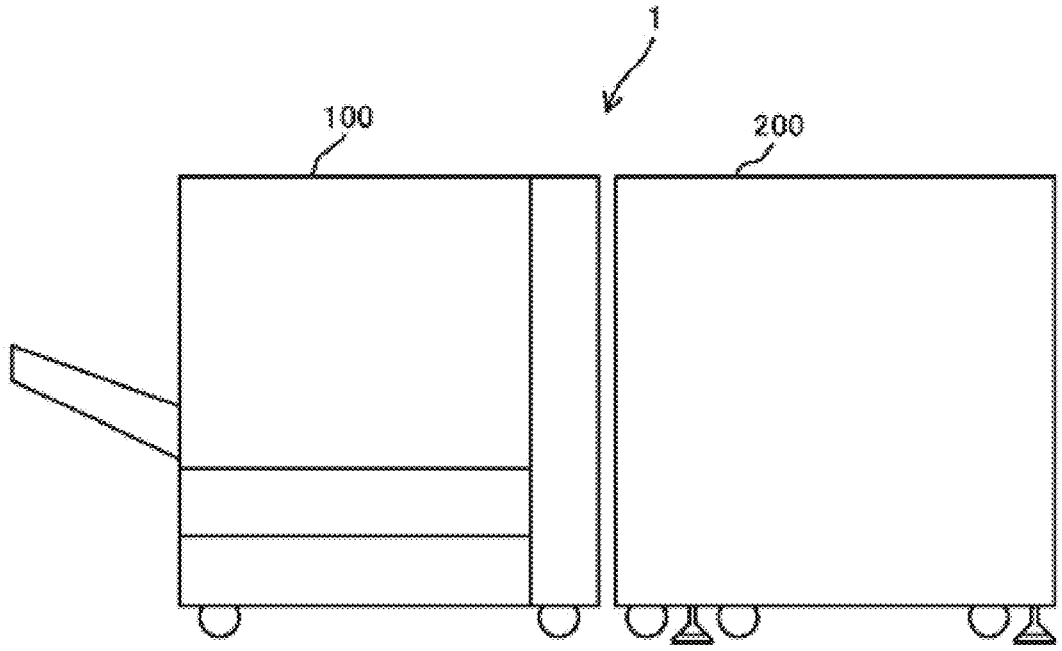
FIG. 1 is a schematic view illustrating an example of an image forming system according to the present disclosure.

FIG. 1 illustrates an example of an image forming system according to the present disclosure. As illustrated in FIG. 1, the image forming system 1 includes an image forming apparatus as printer 100 and a sheet feeding device 200 to teed the envelope to the image forming apparatus 100. The sheet feeding device 200 is disposed on a side of the image forming apparatus 100.

Figure 2:
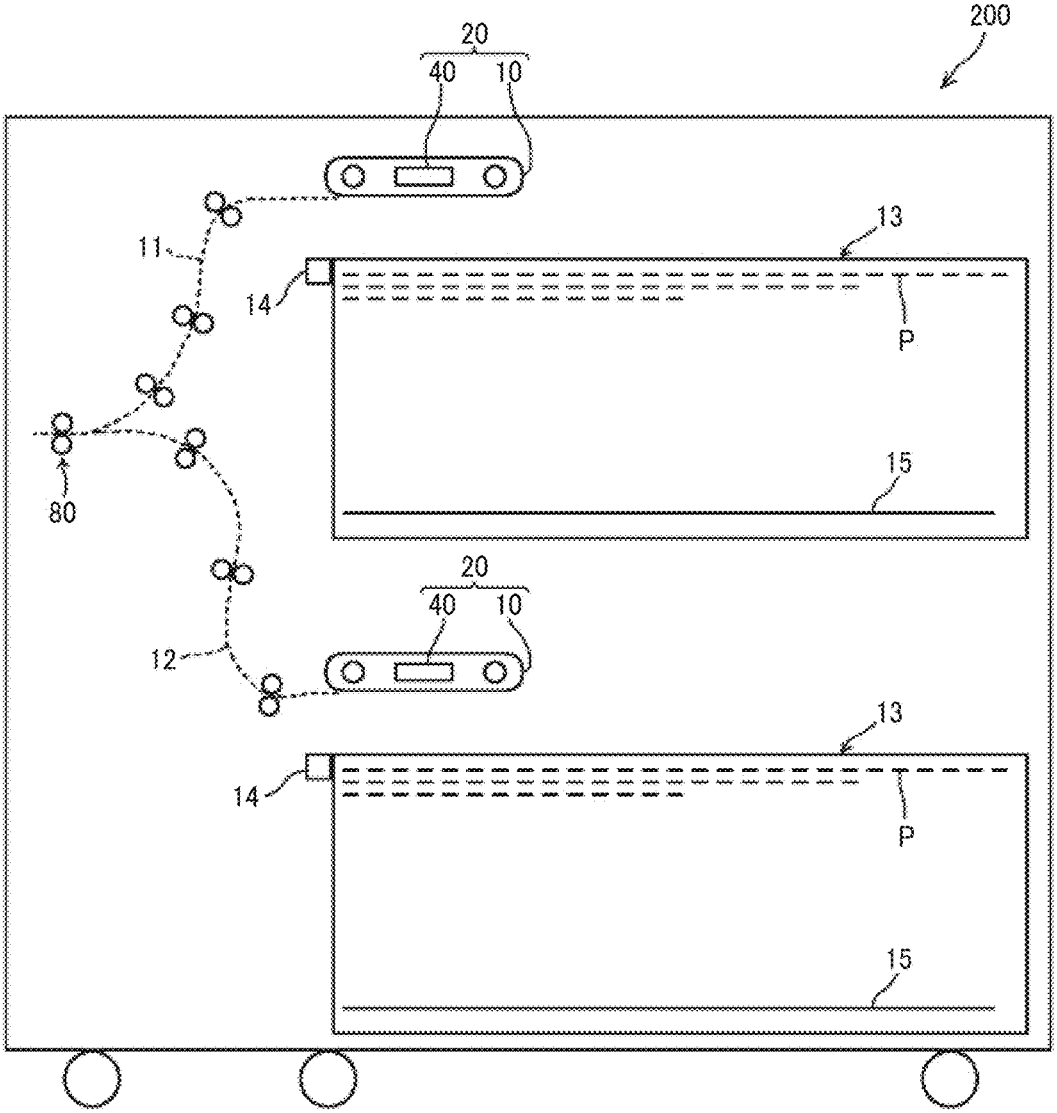
FIG. 2 is a schematic view illustrating an example of a sheet feeding device according to the present disclosure.

FIG. 2 illustrates an example of the sheet feeding device 200 according to the present disclosure. As illustrated in FIG. 2, the sheet feeding device 200 includes a sheet feeding tray 13 disposed upper side and the sheet feeding tray 13 disposed lower side. The sheet feeding tray 13 includes an elevatable bottom plate 15. An envelope bundle is stacked on the bottom plate 15. The sheet feeding tray 13 also includes a sheet (e.g., recording medium) detecting sensor 14 for controlling an elevating operation of the bottom plate 15. In the present disclosure, the sheet feeding tray 13 is capable of accommodating (i.e., stacking) up to 2500 sheets of paper, but sheet feeding tray 13 may accommodate a different number of sheets in alternative configurations.

The sheet feeding device 200 also includes a sheet feeding mechanism 20 to separate one envelope P from the envelope bundle stacked on the bottom plate 15 and feed the envelope P. The sheet feeding mechanism 20 is disposed above the sheet feeding tray 13. The sheet feeding mechanism 20 includes a suction belt 10 and an air suction-and-blowing device 40. The suction belt 10 and the air suction-and-blowing device 40 configure a suction conveyance mechanism.

The envelope P stacked on the feeding tray 13 disposed lower side passes through a lower conveying path 12. Then, the envelope P is conveyed to the image forming apparatus 100 by a pair of rollers 80. The envelope P stacked on the feeding tray 13 disposed upper side passes through an upper conveying path 11. Then, the envelope P is conveyed to the image forming apparatus 100 by a pair of rollers 80.

The sheet feeding mechanism 20 is not limited to the suction conveyance mechanism. The sheet feeding mechanism 20 may be a friction separation mechanism. That is, a roller may contact the envelope P and the envelope P may be fed by the rotation of the roller.

Figure 3:
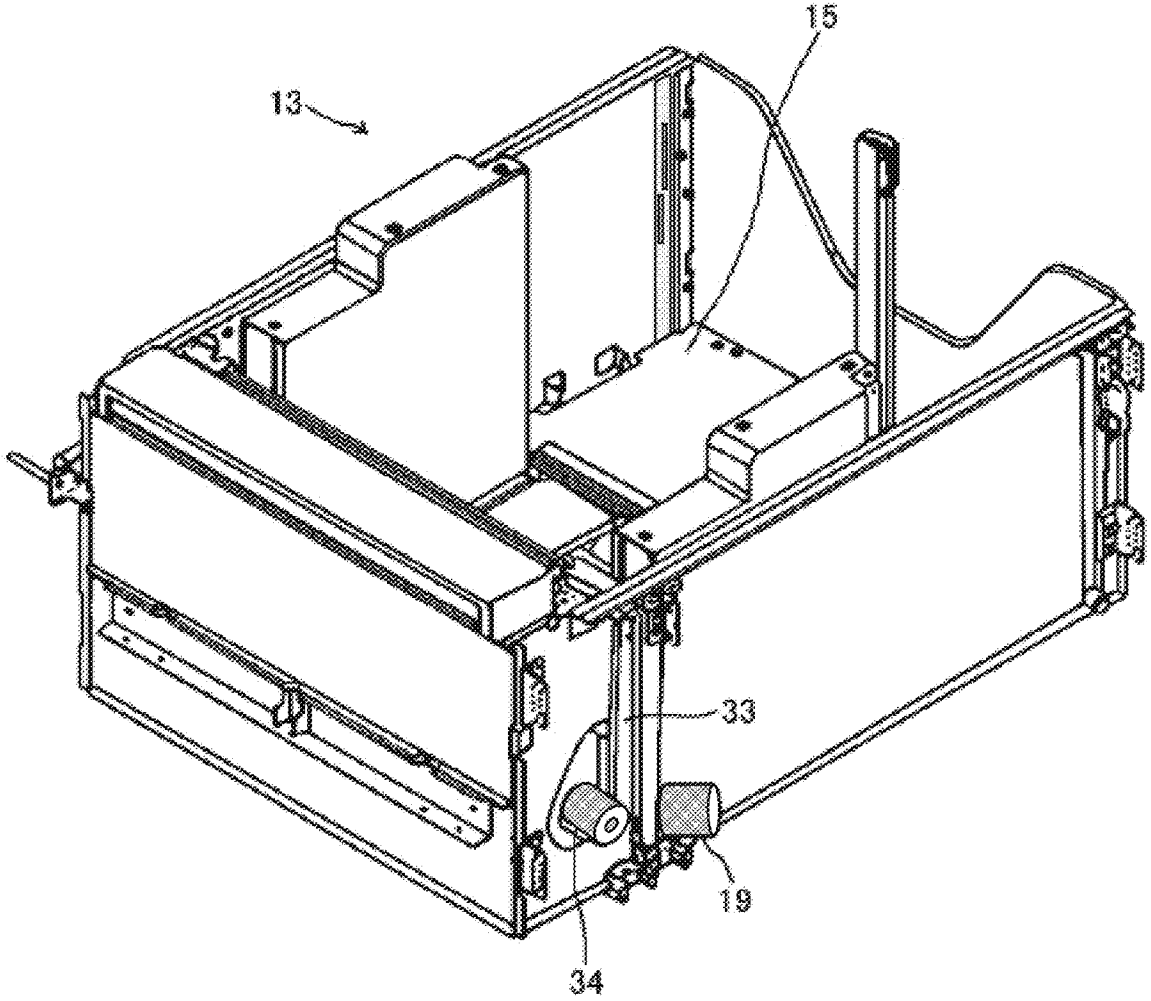
FIG. 3 is a perspective view illustrating an example of an elevating mechanism to elevate a bottom plate according to the present disclosure.

FIG. 3 is a perspective view illustrating an example of an elevating mechanism to elevate a bottom plate. As illustrated in FIG. 3, the bottom plate 15 is connected to a wire 33. The wire 33 is wound to a pulley 34. The pulley 34 is connected to a drive shaft of a motor 19 and is rotated by rotation of the drive shaft. Thus, the wire 33 is took up by rotation of the pulley 34 so that the bottom plate 15 is raised up.

The elevating mechanism for a bottom plate 15 is not limited to a configuration illustrated in FIG. 3. For example, the bottom plate 15 may be attached to a rotating belt whose surface moves in the vertical direction.

Figure 4:
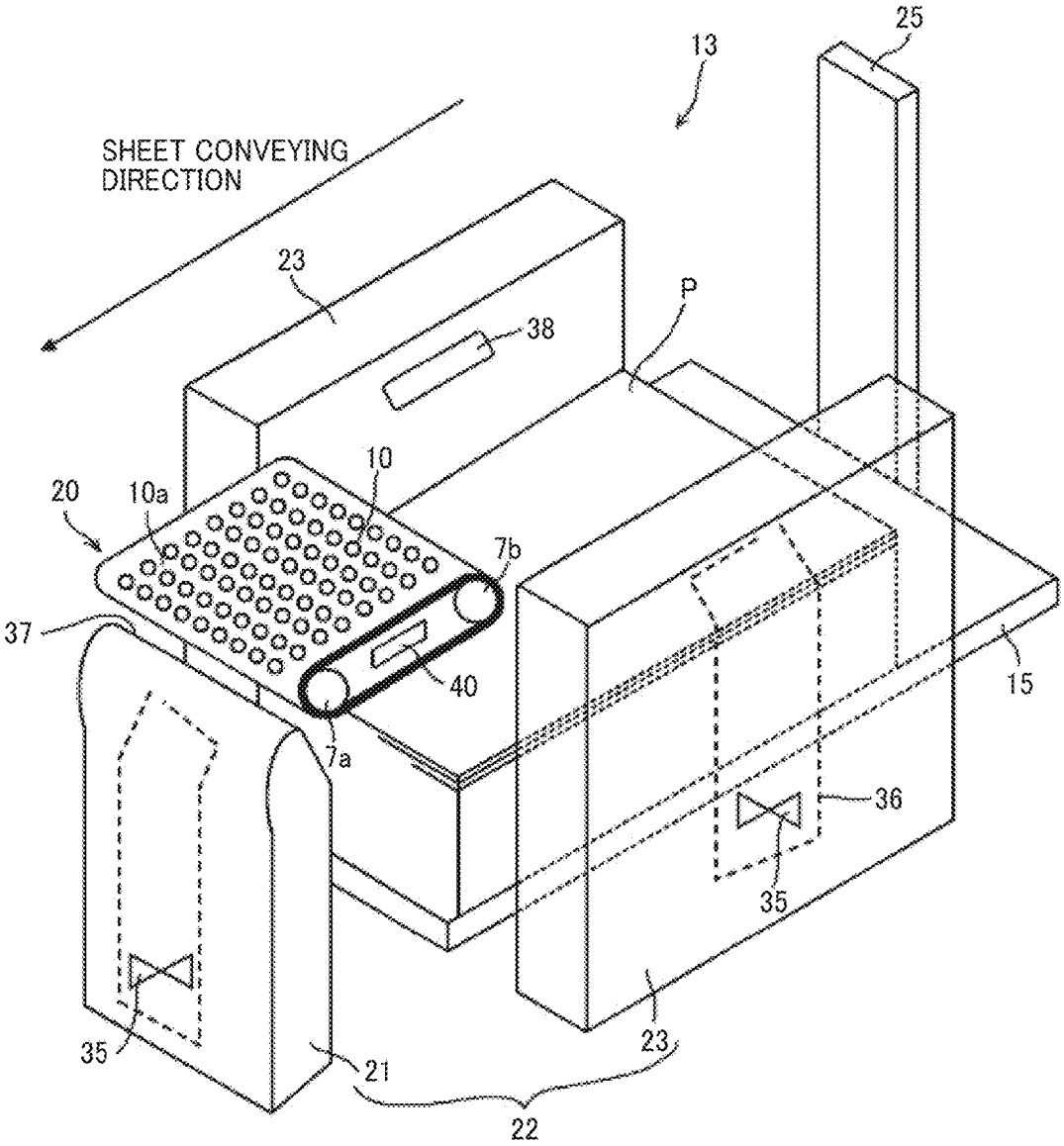
FIG. 4 is a schematic perspective view illustrating an example of a sheet feeding tray and an example of a sheet feeding mechanism according to the present disclosure.

FIG. 4 is a schematic perspective view illustrating an example of the sheet feeding tray and an example of the sheet feeding mechanism. On the suction belt 10, a suction hole 10*a* formed through the suction belt 10 is provided over an entire area in a circumferential direction. The suction belt 10 is also stretched by a stretching roller 7*a* and a stretching roller 7*b*. The air suction-and-blowing device 40 is disposed in a space surrounded by the suction belt 10.

The sheet feeding tray 13 includes a pair of side fences 23 and an end fence 25. The pair of side fences 23 lines up and holds the envelope bundle stacked on the bottom plate 15 in a direction perpendicular to a sheet feeding direction (i.e., sheet conveying direction). The end fence 25 lines up and holds the envelope bundle stacked on the bottom plate 15 in the sheet feeding direction. In other words, the pair of side fences 23 contacts a side end of the envelope P in the direction perpendicular to the sheet feeding direction and regulates the side end of the envelope P. In a similar manner, the end fence 25 contacts a rear end of the envelope P in the sheet feeding direction and regulates the rear end of the envelope P.

The sheet feeding tray 13 also includes a blower 22 to blow air on an upper portion of the envelope bundle and float the envelope P disposed in the upper portion of the envelope bundle. The blower 22 includes a blower fan 35, a front duct 21 and a pair of side ducts 36 formed in the pair of side fences 23. The blower fan 35 delivers air to the front duct 21 and the pair of side ducts 36. The air sent to the front duct 21 is blown out from the air outlet 37 opposed to an upper front-end (i.e., downstream side in the sheet feeding direction) of the envelope bundle and is blown to the upper front-end of the envelope bundle. The air sent to the pair of side duct 36 is blown out from the air outlet 38 opposed to an upper side-end of the envelope bundle and is blown to the upper side-end of the envelope bundle. By this configuration, the envelope P disposed in the upper portion of the envelope bundle is floated.

Figure 5:
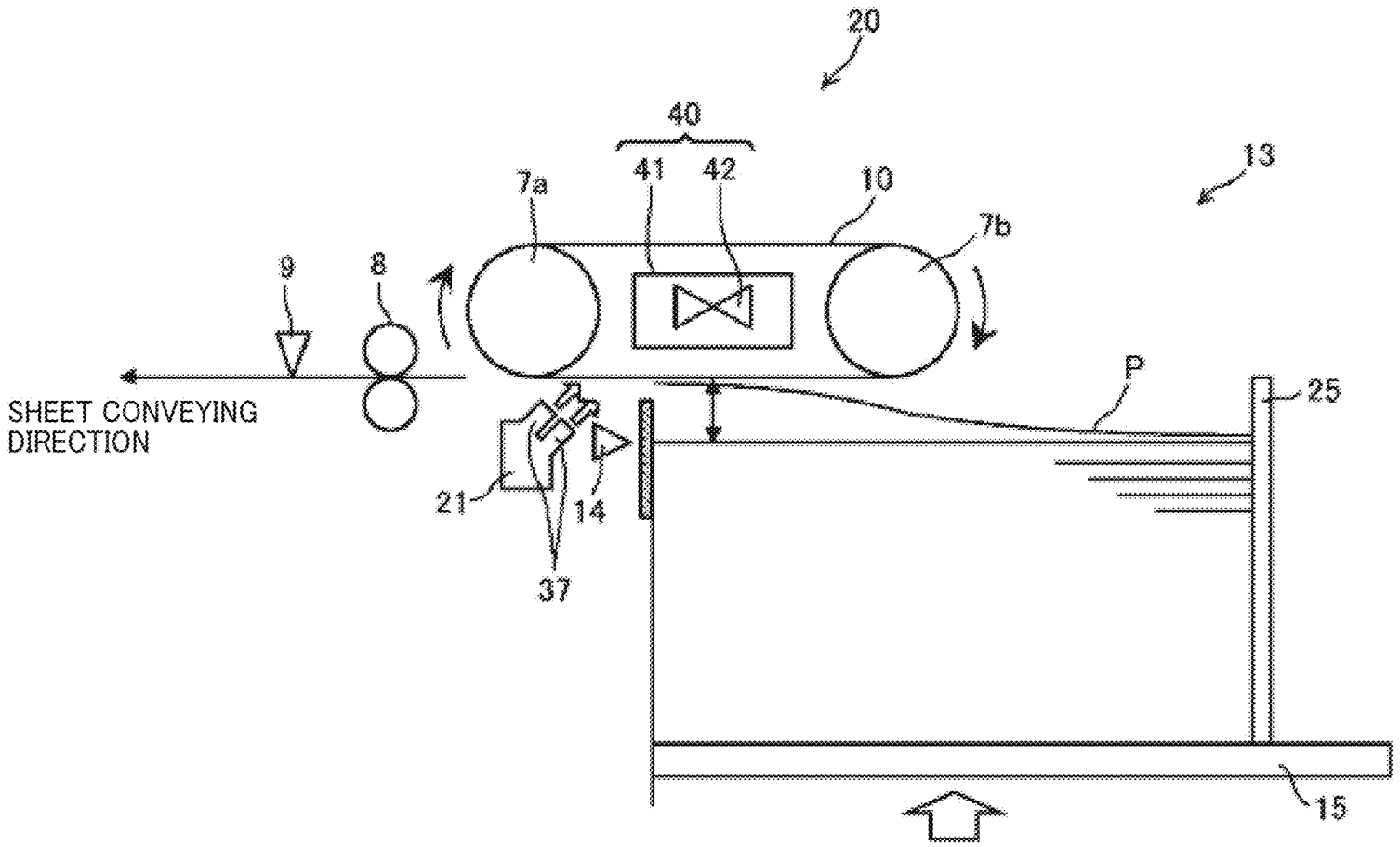
FIG. 5 is a schematic cross-sectional view illustrating the sheet feeding tray and the sheet feeding mechanism according to the present disclosure.

FIG. 5 is a schematic cross-sectional view illustrating the sheet feeding tray and the sheet feeding mechanism. The air suction-and-blowing device 40 includes a duct 41 as an air flow channel and an air suction-and-blowing fan 42 which sucks or blows air through the duct 41. The floating envelope P is pushed down by a positive pressure which is generated by the air suction-and-blowing device 40. Also, the envelope P is sucked and attached to the suction belt 10 by a negative pressure which is generated by the air suction-and-blowing device 40.

As illustrated in FIG. 5, a pair of conveyance rollers 8 as a downstream conveyance member disposed on a downstream side in the sheet conveying direction of the suction belt 10. The pair of conveyance rollers 8 conveys the envelope P further toward the downstream side. The conveying force of the pair of conveying rollers 8 is set to be larger than that of the suction belt 10. Also, a sheet feeding sensor 9 to detect the envelope P to be conveyed is disposed on a downstream side in the sheet conveying direction of the pair of conveyance rollers 8.

Figure 6:
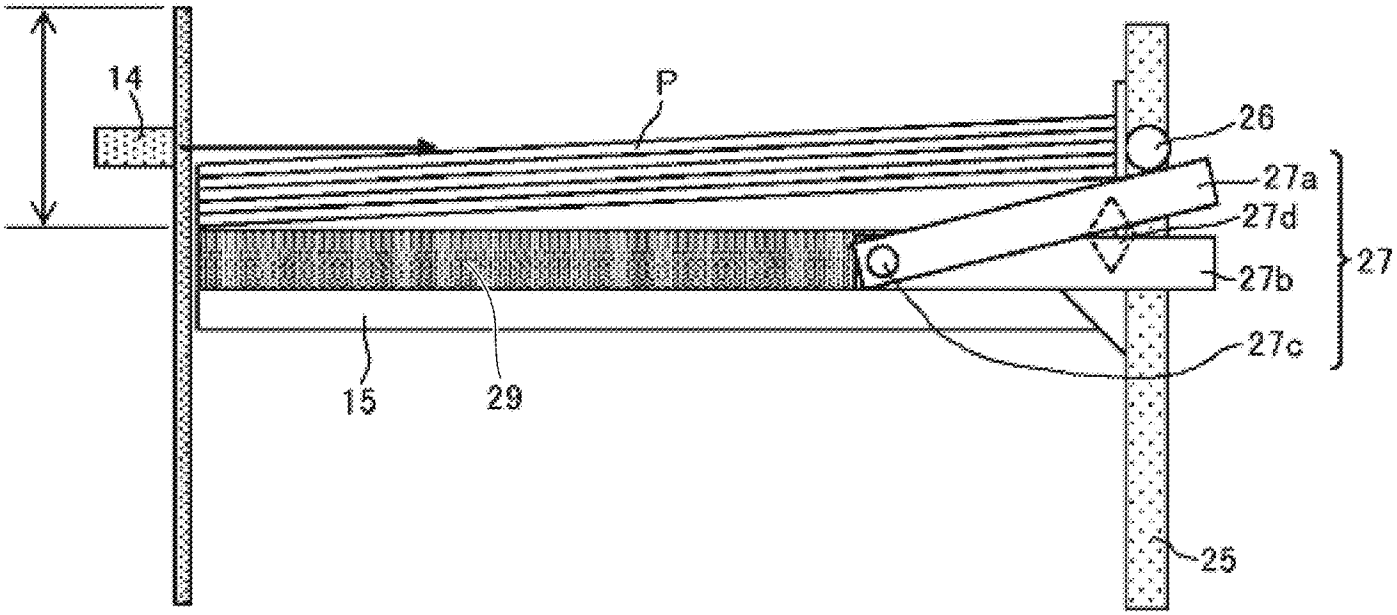
FIG. 6 is an enlarged cross-sectional view illustrating a vicinity of the bottom plate according to the present disclosure.

FIG. 6 is an enlarged cross-sectional view illustrating a vicinity of the bottom plate. As illustrated in FIG. 6, an auxiliary tray 29 and a tilt table 27 are disposed on the bottom plate 15, and the envelope P is disposed on both the auxiliary tray 29 and the tilt table 27. Here, a portion having a relatively small thickness of the envelope P is set on the tilt table 27.

The bottom plate 15 is configured to elevate in a vertical direction. The bottom plate 15 continues to move upward until the envelope P is detected by the sheet detecting sensor 14. The tilt table 27 moves in the vertical direction supported by the end fence 25. Therefore, along with elevating of the bottom plate 15, the auxiliary tray 29 and the tilt table 27 are elevated (i.e., moved upward and downward).

The tilt table 27 is configured by connected an upper table 27*a* and a lower table 27*b* with a pivot 27*c*. A pressurizing spring 27*d* as resilient member (i.e., a pressure member) is disposed between the upper table 27*a* and the lower table 27*b*. Because the pressurizing spring 27*d* urges (i.e. presses) the upper table 27*a* upward, the upper table 27*a* rotates around the pivot 27*c*. Thus, the upper table 27*a* is obliquely supported with respect to the lower table 27*b*. By this configuration, the portion of the envelope P disposed on the tilt table 27 is lifted upward with respect to the lower table 27*b* by the upper table 27*a*.

A stopper 26 for restricting a rotation of the upper table 27*a* is detachably attached to an upper side (i.e., an upper portion in a moving direction of the tilt table 27) of the end fence 25. The stopper 26 is provided at a position where the envelope P stacked on the upper table 27*a* does not contact the sheet feeding mechanism 20 shown in FIG. 5.

Figure 7:
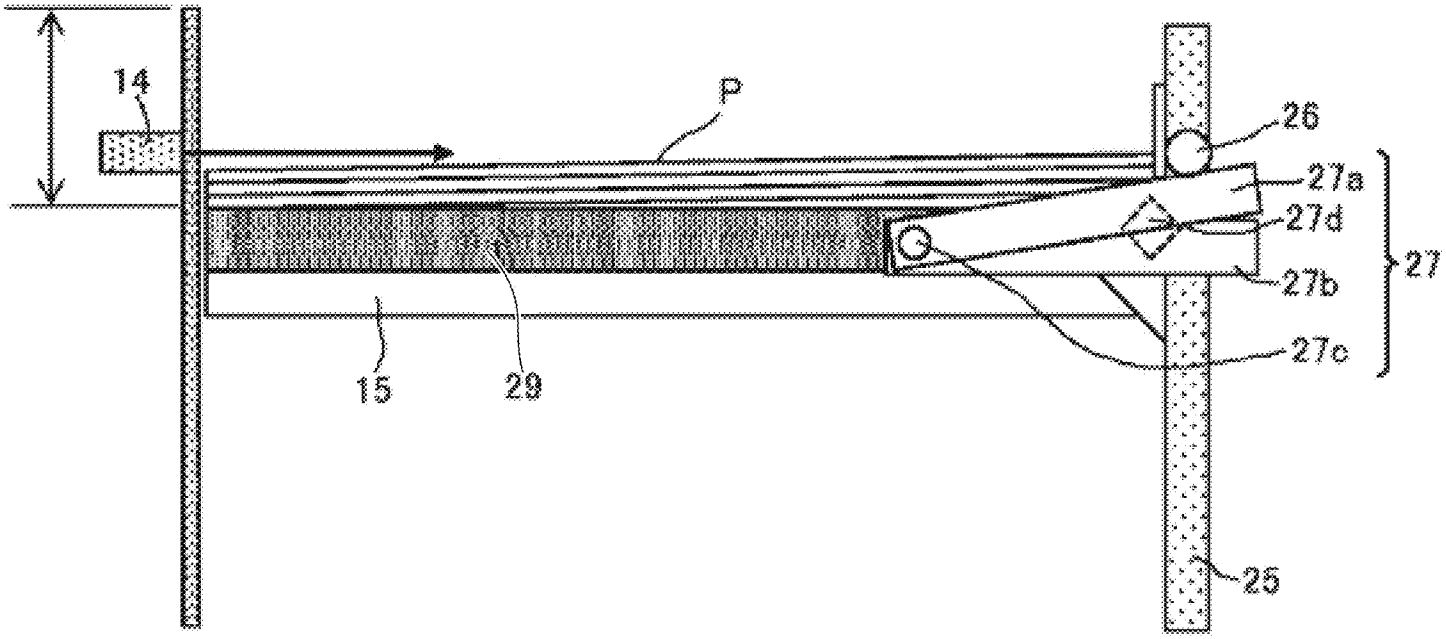
FIG. 7 is an enlarged cross-sectional view illustrating the vicinity of the bottom plate according to the present disclosure.

FIG. 7 is an enlarged cross-sectional view illustrating the vicinity of the bottom plate. FIG. 7 shows a state in which the number of envelopes stacked on the bottom plate 15 is smaller than that in FIG. 6. The bottom plate 15 continues to move upward until the envelope P is detected by the sheet detecting sensor 14. As the bottom plate 15 moves upward, the upper table 27*a* contacts the stopper 26. As the bottom plate 15 further moves upward after the upper table 27*a* contacts the stopper 26, the tilt table 27 is folded. That is, as the bottom plate 15 moves upward, the upper table 27*a* is pushed down by the stopper 26, so that the inclination of the upper table 27*a* with respect to the auxiliary tray 29 becomes smaller.

Figure 8:
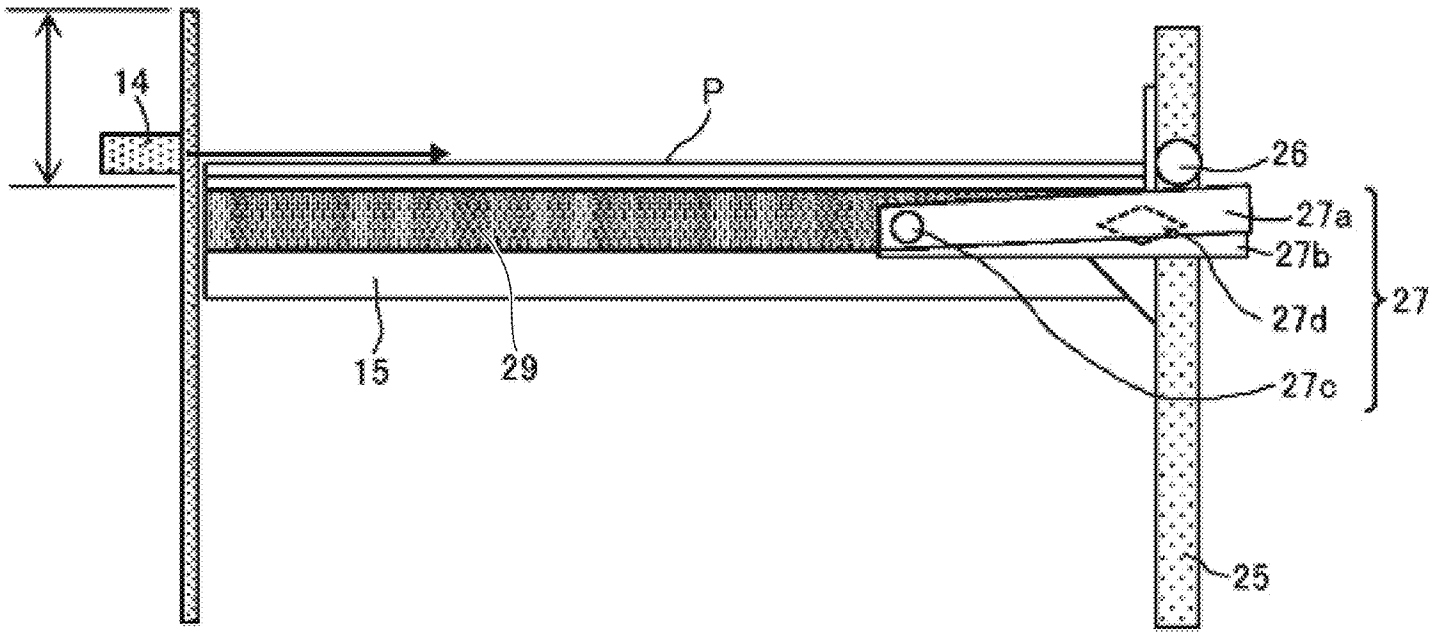
FIG. 8 is an enlarged cross-sectional view illustrating the vicinity of the bottom plate according to the present disclosure.

FIG. 8 is an enlarged cross-sectional view illustrating the vicinity of the bottom plate. FIG. 8 shows a state in which the number of envelopes stacked on the bottom plate 15 is smaller than that in FIG. 7. As the bottom plate 15 further moves upward, the tilt table 27 is further folded such that a height of the tilt table 27 and a height of the auxiliary tray 29 become substantially same.

In the present disclosure, because the upper table 27*a* is rotatable with respect to the lower table 27*b*, the inclination of the upper table 27*a* with respect to the auxiliary tray 29 is variable in accordance with an amount of the envelope bundle stacked on the tilt table 27.

In general, if the amount of stacked envelope bundle is small, a height difference in an uppermost surface of the stacked envelope bundle is small. Thus, it is necessary to reduce the inclination of the upper table 27*a* with respect to the auxiliary tray 29. In the present disclosure, when the amount of stacked envelope bundle is small, the bottom plate 15 moves upward and then the upper table 27*a* is pushed down by the stopper 26. Since the inclination of the upper table 27*a* with respect to the auxiliary tray 29 becomes smaller, even if the amount of stacked envelope bundle decreases, the height difference in the uppermost surface of the envelope bundle may be reduced.

Figure 9:
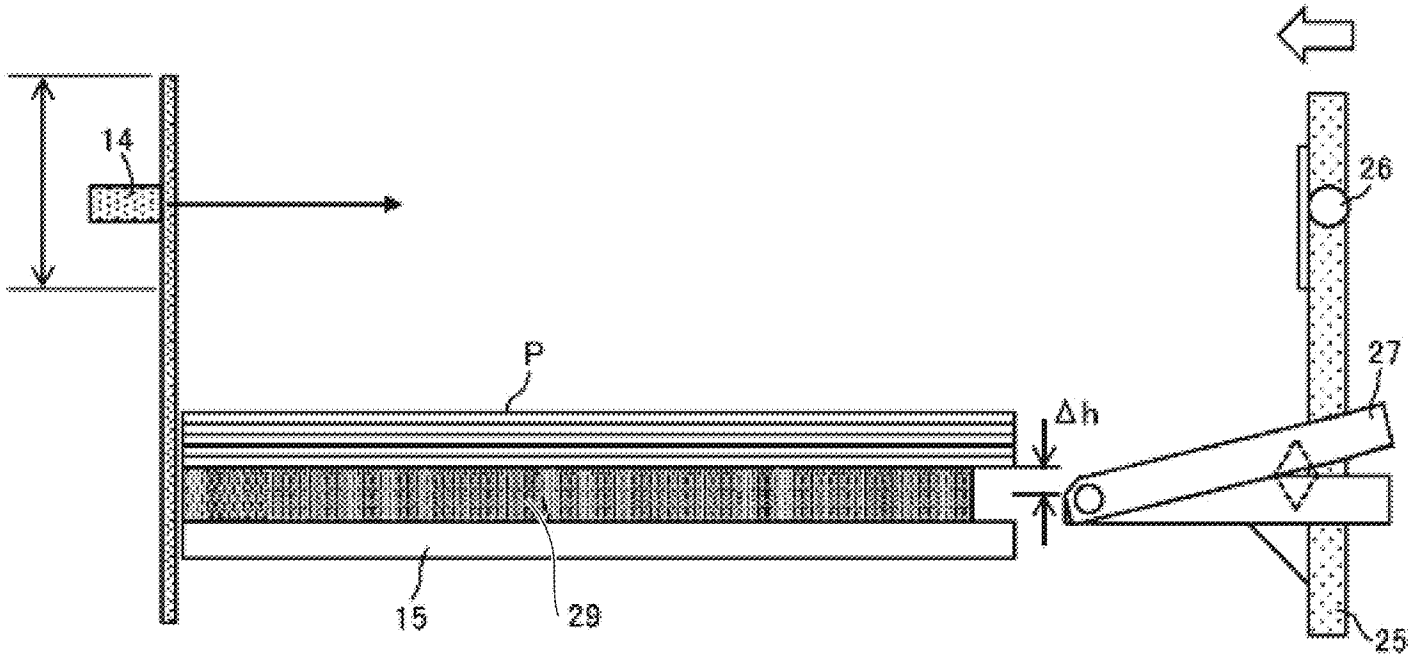
FIG. 9 is an enlarged cross-sectional view illustrating the vicinity of the bottom plate according to the present disclosure.

FIG. 9 is an enlarged cross-sectional view illustrating the vicinity of the bottom plate. FIG. 9 shows a state in which the end fence 25 is attaching to the auxiliary tray 29 after the envelope P is stacked on the auxiliary tray 29. The end fence 25 is detachable from a main body of the sheet feeding device 200 together with the tile table 27. An upper surface of a tip portion on a downstream side in the sheet feeding direction of the tilt table 27 is positioned lower than a stacking surface (i.e., upper surface) of the auxiliary tray 29 by a distance Δh. Thus, it is possible to attach the tilt table 27 to the auxiliary tray 29 without being caught in the envelope bundle stacked on the auxiliary tray 29.

Figure 10:
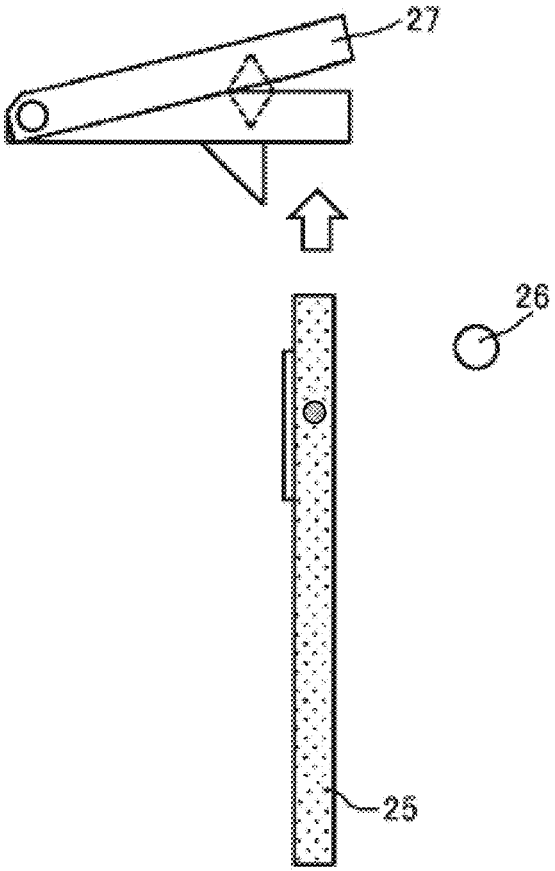
FIG. 10 is a side view illustrating an exemplary of a tilt table and an end fence according to the present disclosure.

FIG. 10 is a side view illustrating an example of a tilt table and an end fence. FIG. 10 shows a state in which the tilt table 27 has been detached from the end fence 25. When the stopper 26 is detached from the end fence 25, the tilt table 27 is moved upward and may be detached from the end fence 25.

Figure 11:
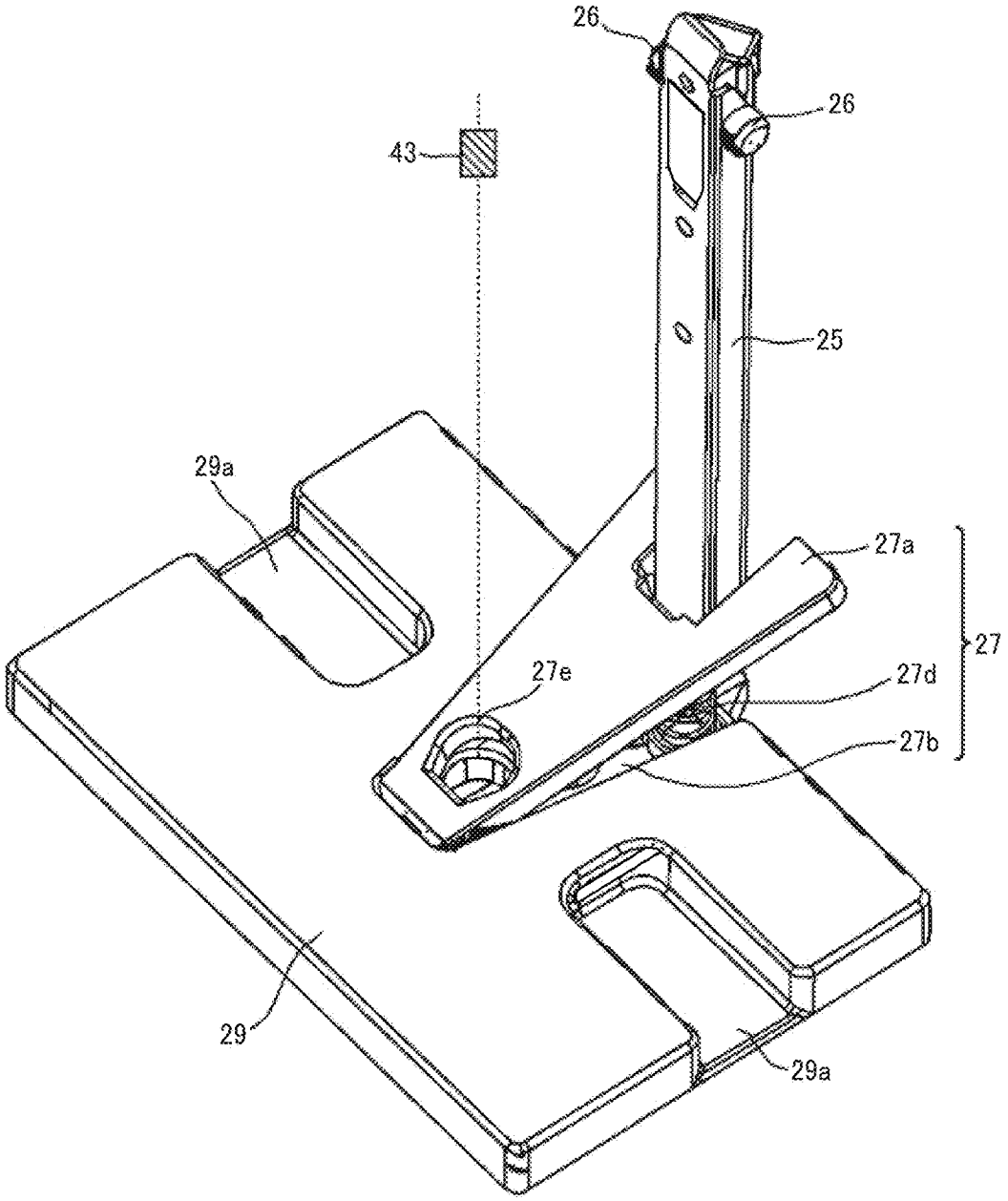
FIG. 11 is a perspective view illustrating an example of an auxiliary tray, the tilt able and the end fence viewed from diagonally forward according to the present disclosure.

FIG. 11 is a perspective view illustrating an example of the auxiliary tray, the tilt table and the end fence viewed from diagonally forward. The auxiliary tray 29 is configured to be engaged with the tilt table 27. Also, an air pocket 29*a* is formed on both sides of the auxiliary tray 29. The air pocket 29*a* is a groove formed on the auxiliary tray 29. Air blown out from the air outlet 38 formed in the side fence 23 may be collected in the air pocket 29*a*. By this configuration, a heavy envelope or an envelope which is difficult to keep balance during a floating state is lifted by the air in the air pocket 29*a*.

A sensor 43 for detecting a presence of the envelope stacked on the bottom plate 15 or the auxiliary tray 29 is disposed above the sheet feeding tray 13. The sensor 43 is also referred to as a sheet-end detecting sensor or a sheet-empty detecting sensor. When the bottom plate 15 moves upward, the tilt table 27 comes near to the sensor 43. Thus, the upper table 27*a* is provided with a clearance portion 27*e* formed by an opening hole so that the sensor 43 does not contact the upper table 27*a*.

Figure 12:
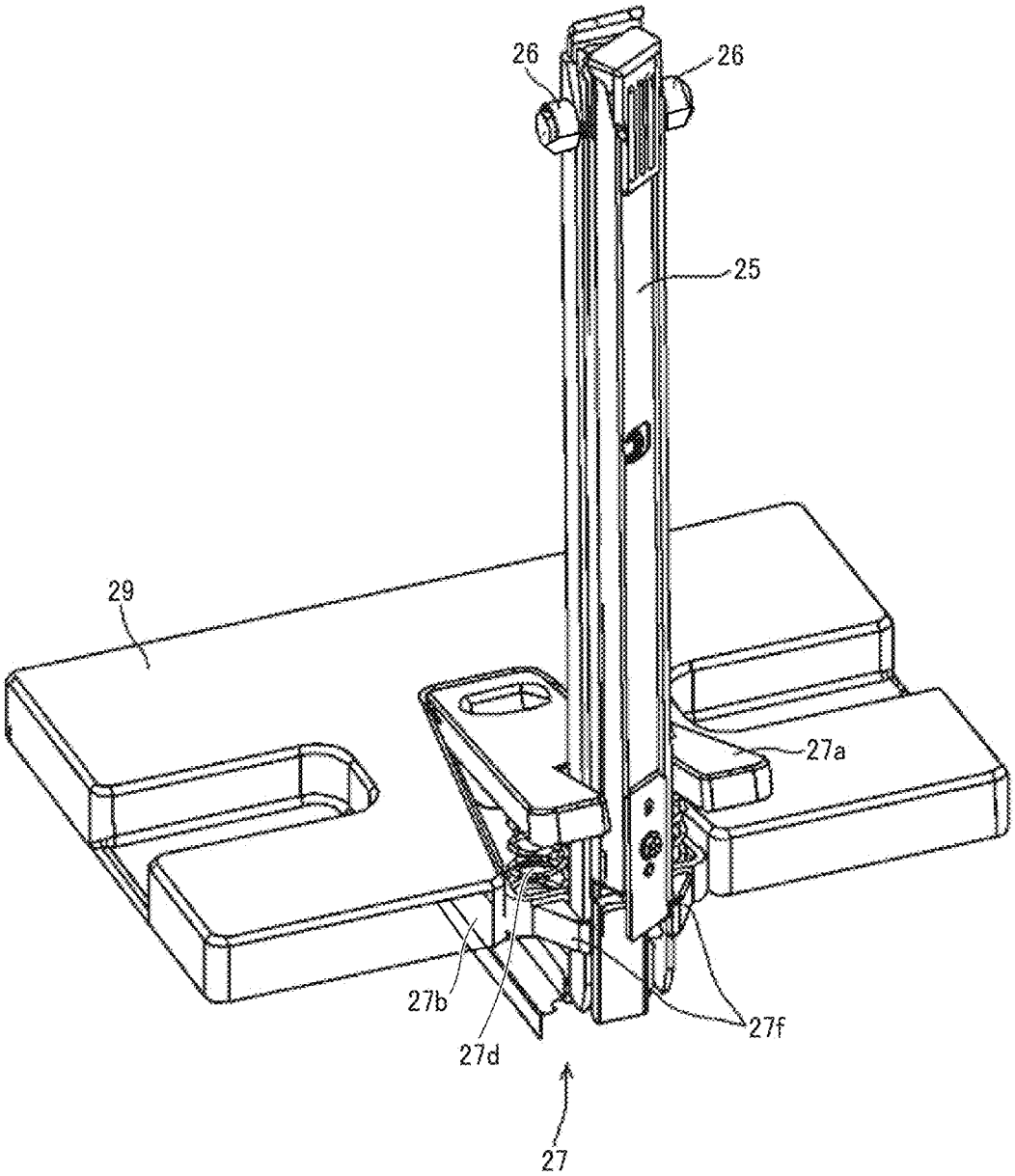
FIG. 12 is a perspective view illustrating the auxiliary tray, the tilt table and the end fence viewed from diagonally backward according to the present disclosure.

FIG. 12 is a perspective view illustrating the auxiliary tray, the tilt table and the end fence viewed from diagonally backward. The stopper 26 is provided with a rotatable roller so that the stopper 26 is easy to slide with respect to the end fence 25. The tilt table 27 is movably supported to the end fence 25 by a hook 27*f* provided on the lower table 27*b*. By this configuration, when the bottom plate 15 elevates, the tilt table 27 moves vertically while being guided by the end fence 25.

The pressurizing spring 27*d* as the pressure member is not limited to a coil spring illustrated in FIG. 12. The pressurizing spring 27*d* may be any as long as it urges (i.e. presses) the upper table 27*a* upward such as a flat spring.

Figure 13:
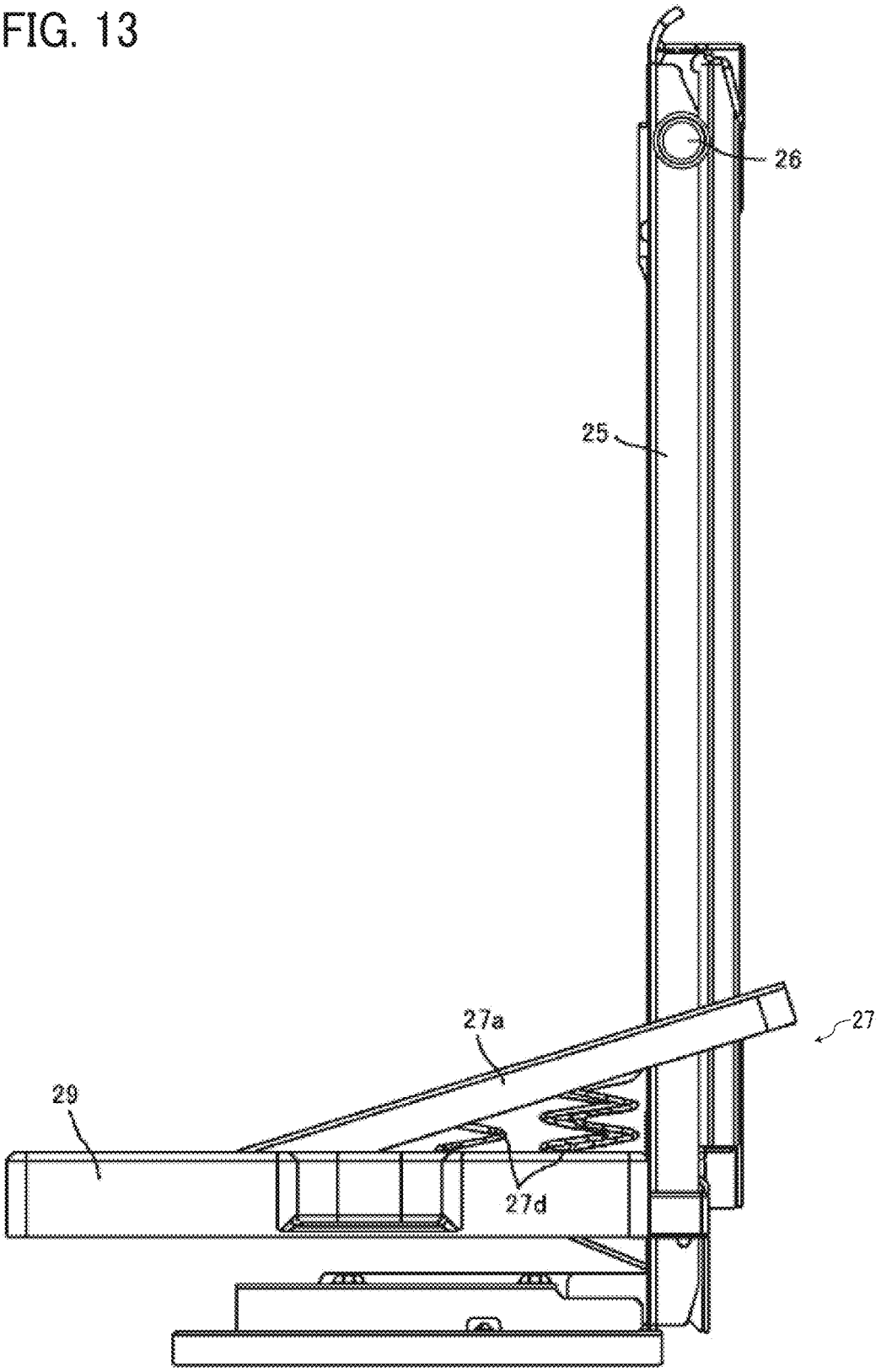
FIG. 13 is a side view illustrating the auxiliary tray, the tilt table and the end fence according to the present disclosure.

FIG. 13 is a side view of the auxiliary tray, the tilt table and the end fence. A plurality of pressurizing springs 27*d* may be provided between the upper table 27*a* and the lower table 27*b*. By this configuration, it is possible to increase an urging force acting on the upper table 27*a* so as to be balanced with the load weight of the envelope on the upper table 27*a*.

Figure 14:
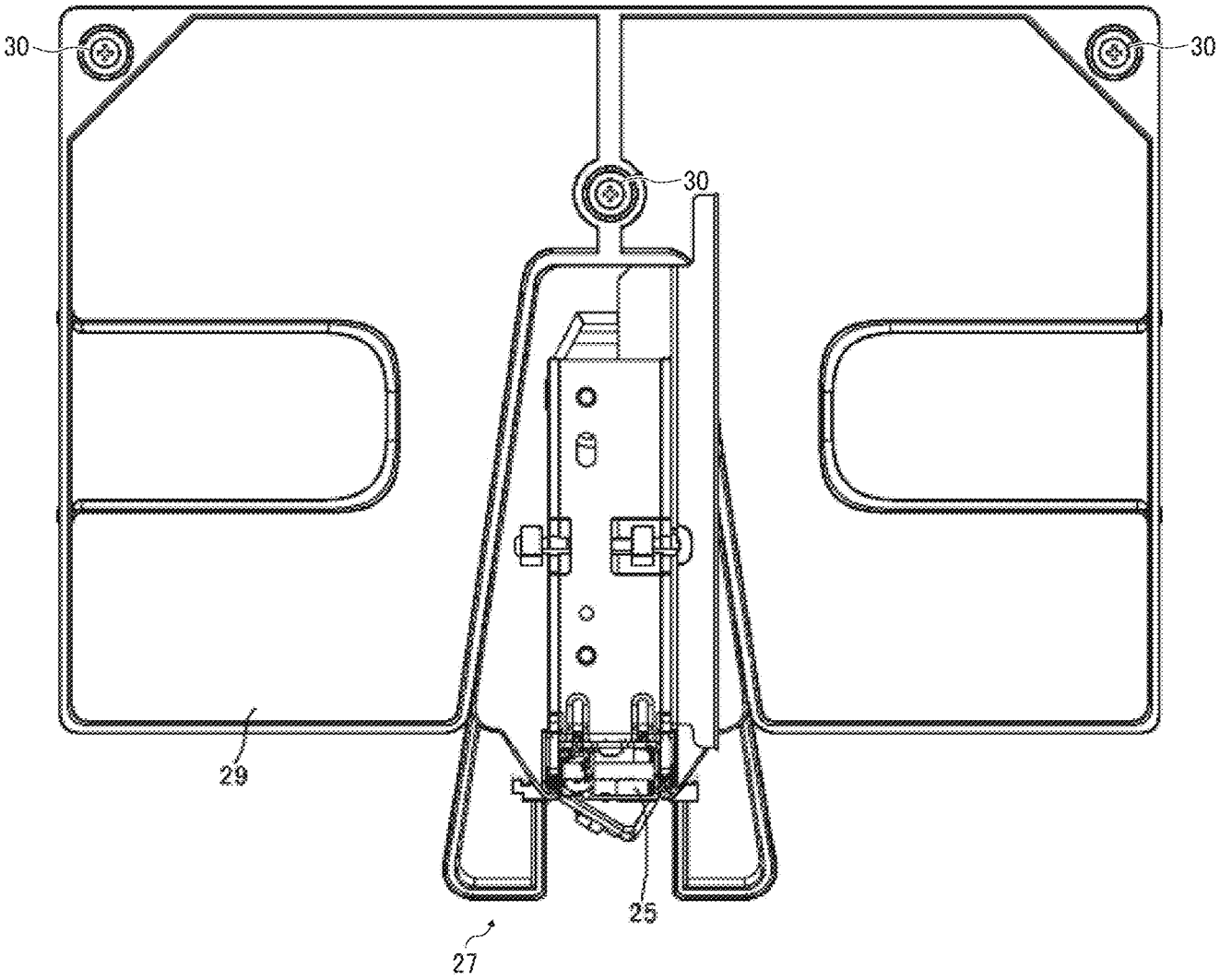
FIG. 14 is a bottom view illustrating the auxiliary tray, the tilt table and the end fence according to the present disclosure.

FIG. 14 is a bottom view of the auxiliary tray, the tilt table and the end fence. A plurality of attaching members 30 to attach the auxiliary tray 29 to the bottom plate 15 are provided on the bottom surface of the auxiliary tray 29. For example, the plurality of attaching members 30 are attracting members such as magnets. By attracting the auxiliary tray 29 to the bottom plate 15, the auxiliary tray 29 may be interlocked with the movement of the bottom plate 15. Also, the plurality of attaching members 30 may be hook-and-loop fasteners. That is, a hook half is provided on the bottom surface of the auxiliary tray 29, and a loop half is provided on an upper surface of the bottom plate 15. As a result, it is easier for an user to attach the auxiliary tray 29 to the bottom plate 15 and detach the auxiliary tray 29 from the bottom plate 15.

Figure 15A:
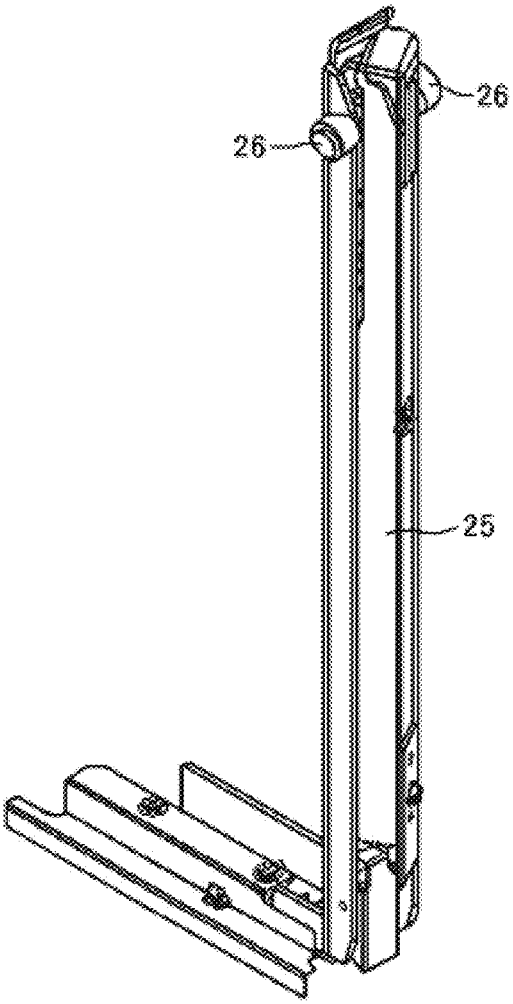
FIG. 15A is a perspective view illustrating an example of the end fence viewed from diagonally backward according to the present disclosure.
Figure 15B:
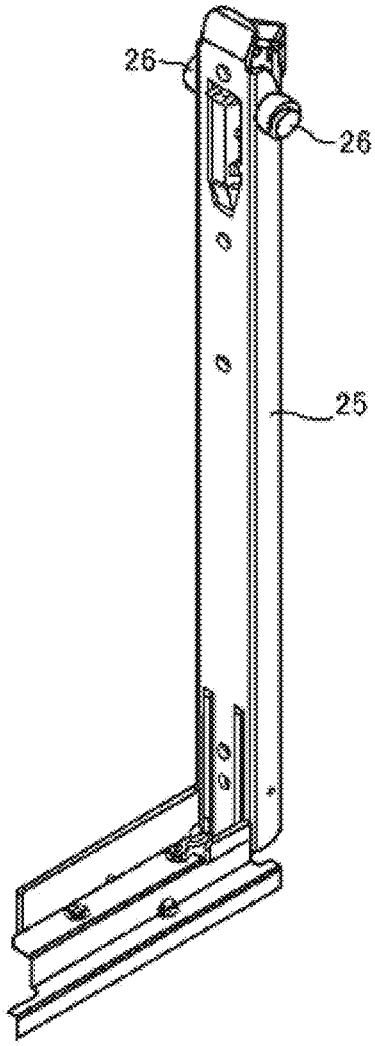
FIG. 15B is a perspective view illustrating an example of the end fence viewed from diagonally forward according to the present disclosure.

FIG. 15A is a perspective view illustrating an example of the end fence viewed from diagonally backward. FIG. 15B is a perspective view illustrating an example of the end fence viewed from diagonally forward. The stopper 26 is disposed on the both sides of the end fence 25 at the upper portion of the end fence 25. Also, the stopper 26 may be disposed on either of sides of the end fence 25.

Figure 16:
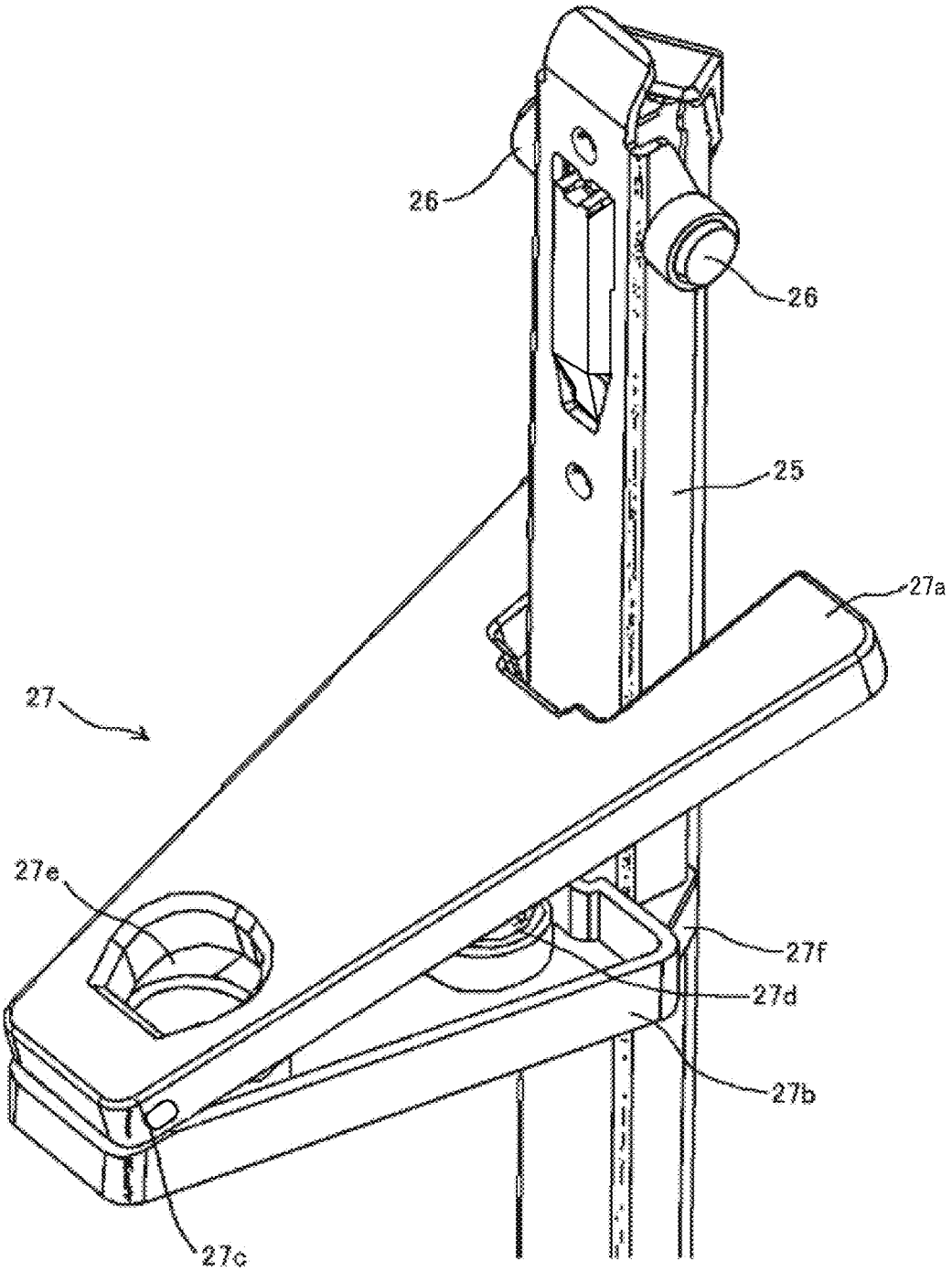
FIG. 16 is a perspective view illustrating a state in which the tilt table is raised to an upper part of the end fence according to the present disclosure.

FIG. 16 is a perspective view illustrating a state in which the tilt table is raised to an upper part of the end fence. The tilt table 27 moves in the vertical direction supported by the end fence 25 so that the tilt table 27 moves upward together with the bottom plate 15. Also, the tilt table 27 moves in the sheet feeding direction together with the end fence 25.

Figure 17:
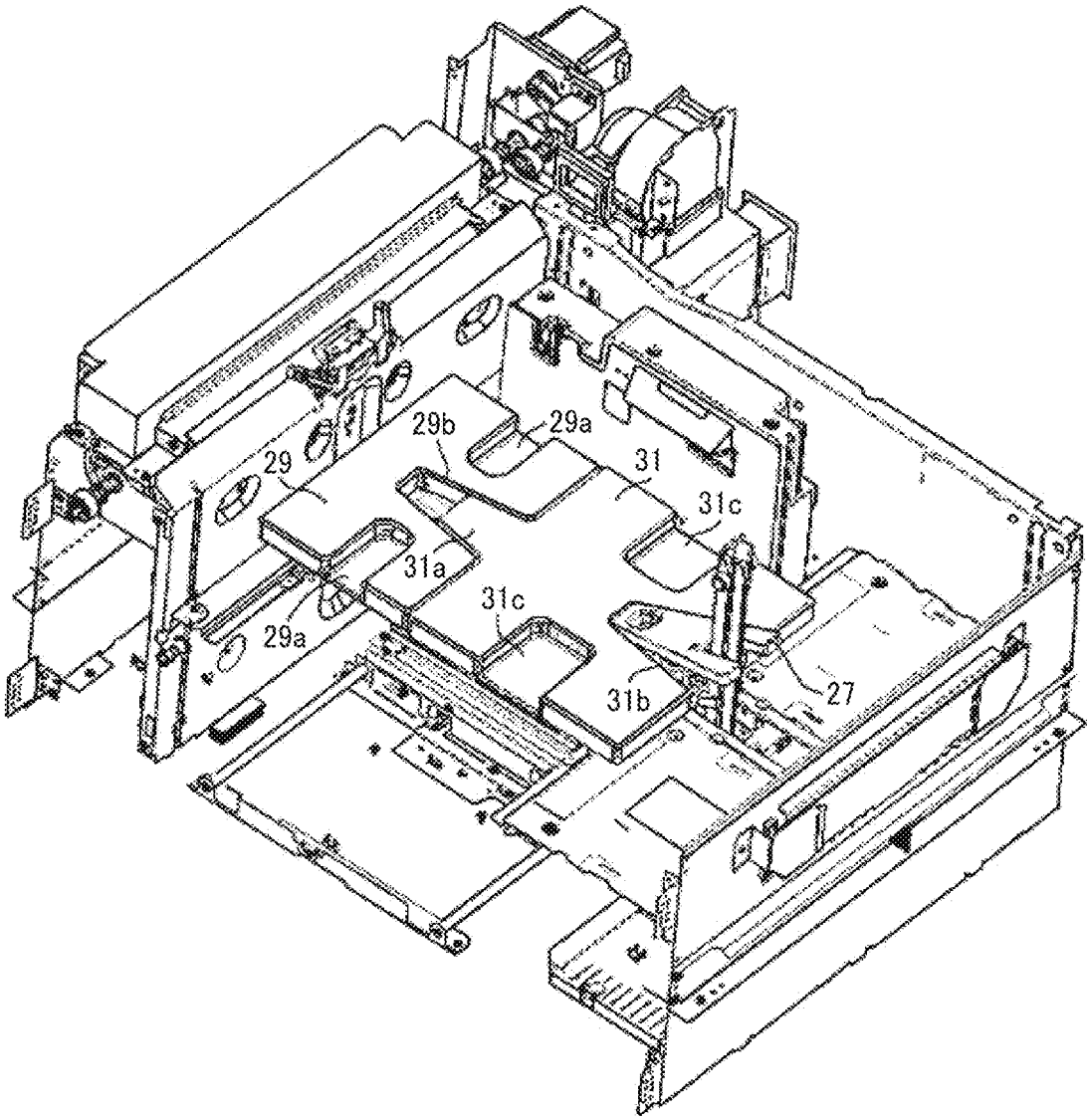
FIG. 17 is a perspective view illustrating an example of the sheet feeding tray viewed from diagonally upward according to the present disclosure.

FIG. 17 is a perspective view illustrating an example of the sheet feeding tray viewed from diagonally upward. The size of the auxiliary tray 29 illustrated in FIG. 17 is adapted to an envelope with 120 mm long and 235 mm wide. An extension tray 31 as an auxiliary tray extension portion adapted to an envelope with 240 mm long and 332 mm wide is provided between the auxiliary tray 29 and the tilt table 27. The extension tray 31 includes a convex part (i.e., projecting part) 31*a* and a recessed part 31*b*. The convex part 31*a* of the extension tray 31 engages a recessed part 29*b* of the auxiliary tray 29. The recessed part 31*b* of the extension tray 31 engages the tile table 27. It is easy to stack a different size envelope by using the extension tray 31 without replacing the tilt table 27. Also, a plurality of attaching members 30 illustrated in FIG. 14 to attach the extension tray 31 to the bottom plate 15 are provided on the bottom surface of the extension tray 31.

Figure 18:
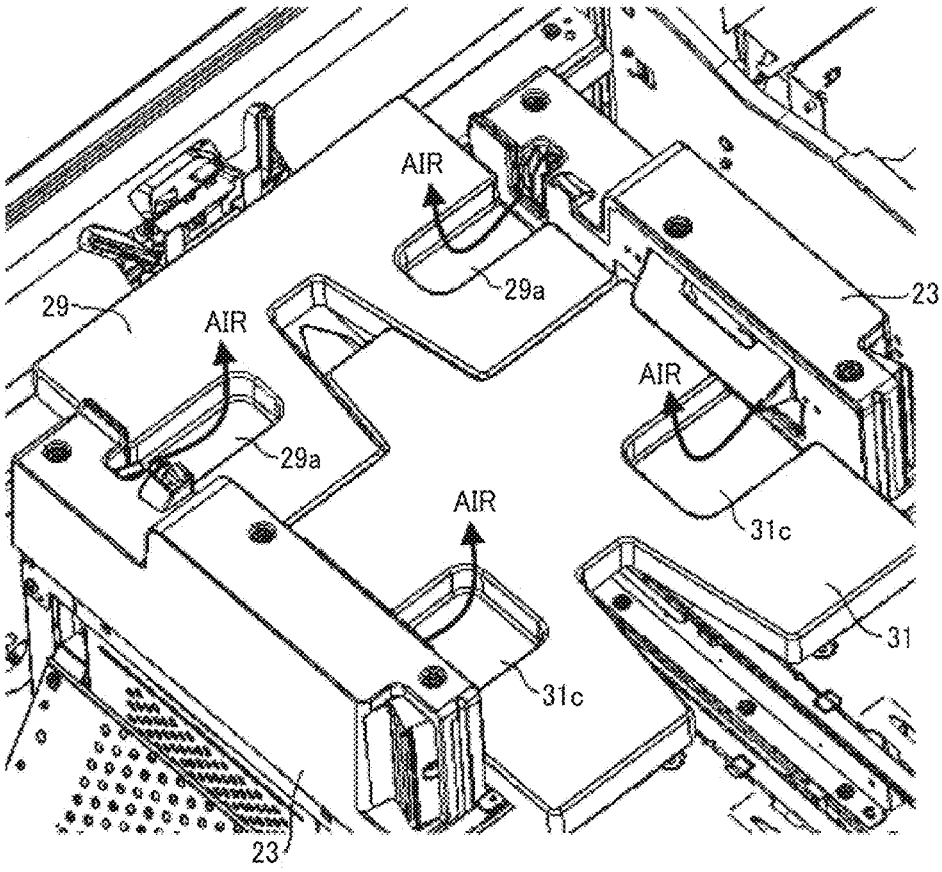
FIG. 18 is a partially enlarged view of the sheet feeding tray illustrated in FIG. 17 according to the present disclosure.

FIG. 18 is a partially enlarged view of the sheet feeding tray illustrated in FIG. 17. A plurality of air pockets 31*c* are provided on both sides of the extension tray 31. The air pocket 31*c* is a groove formed on the extension tray 31. When the amount of the envelope bundle stacked on the extension tray 31 is small, the air outlet 38 formed in the side fence 23 blows air to the air pocket 29*a* of the auxiliary tray 29 and the air pocket 31*c* of the extension tray 31. By this configuration, a heavy envelope or an envelope which is difficult to keep balance during a floating state is lifted by the air in the air pocket 29*a* and the air pocket 31*c*.

Figure 19:
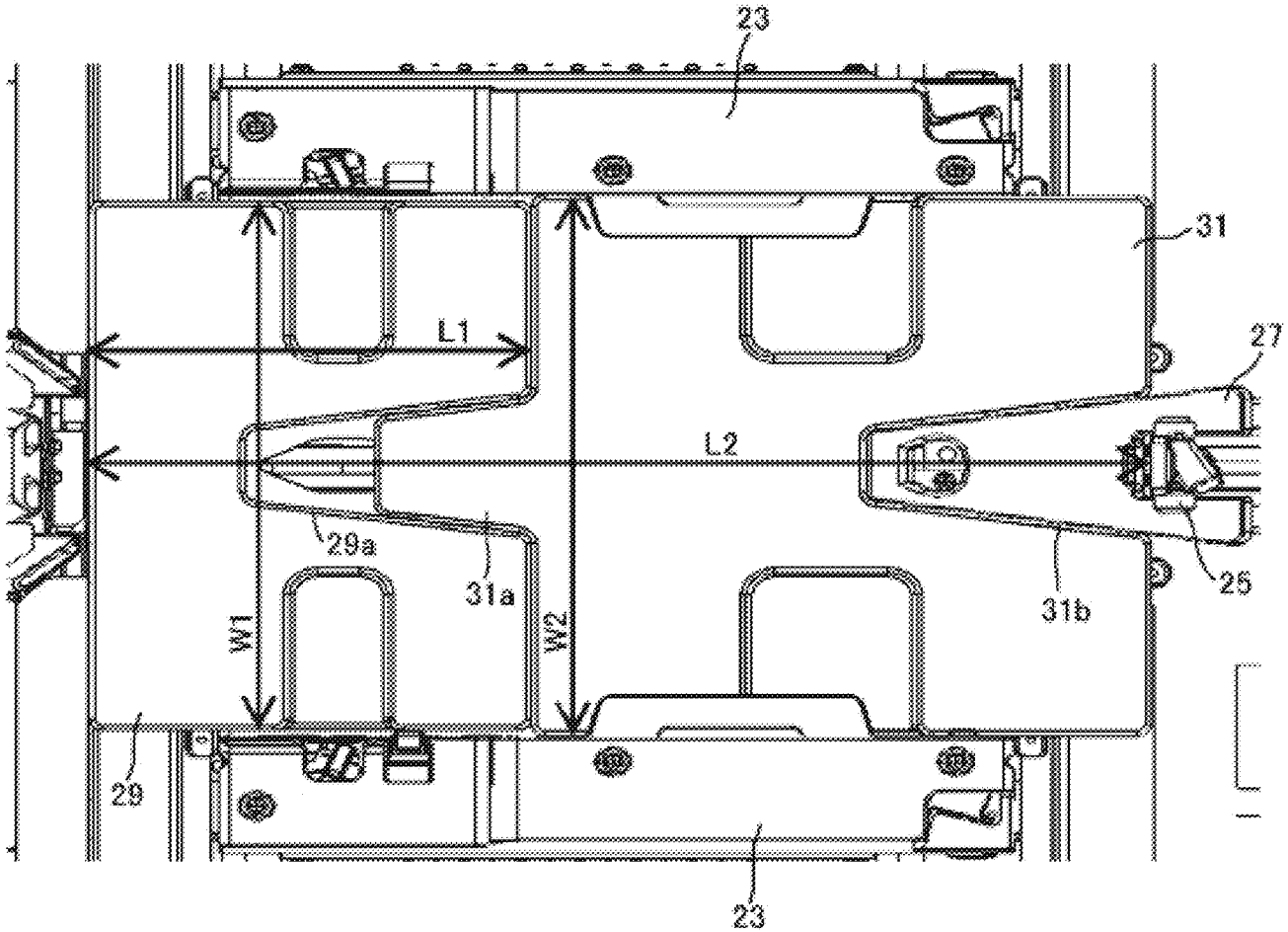
FIG. 19 is a plane view illustrating the sheet feeding tray illustrated in FIG. 17 viewed from upward according to the present disclosure.

FIG. 19 is a plane view illustrating the sheet feeding tray illustrated in FIG. 17 viewed from upward. The pair of side fences 23 contacts the auxiliary tray 29 and the tilt table 27 engages the recessed part 29*b* of the auxiliary tray 29, thereby a width W1 and a length L1 of the envelope to be stacked on the auxiliary tray 29 is determined. Also, in a state which the auxiliary tray 29 engages the extension tray 31, the pair of side fences 23 contacts both the auxiliary tray 29 and the extension tray 31, and the tilt table 27 engages the recessed part 31*b* of the extension tray 31, thereby a width W2 and a length L2 of the envelope to be stacked on both the auxiliary tray 29 and the extension tray 31 is determined.

Figure 20:
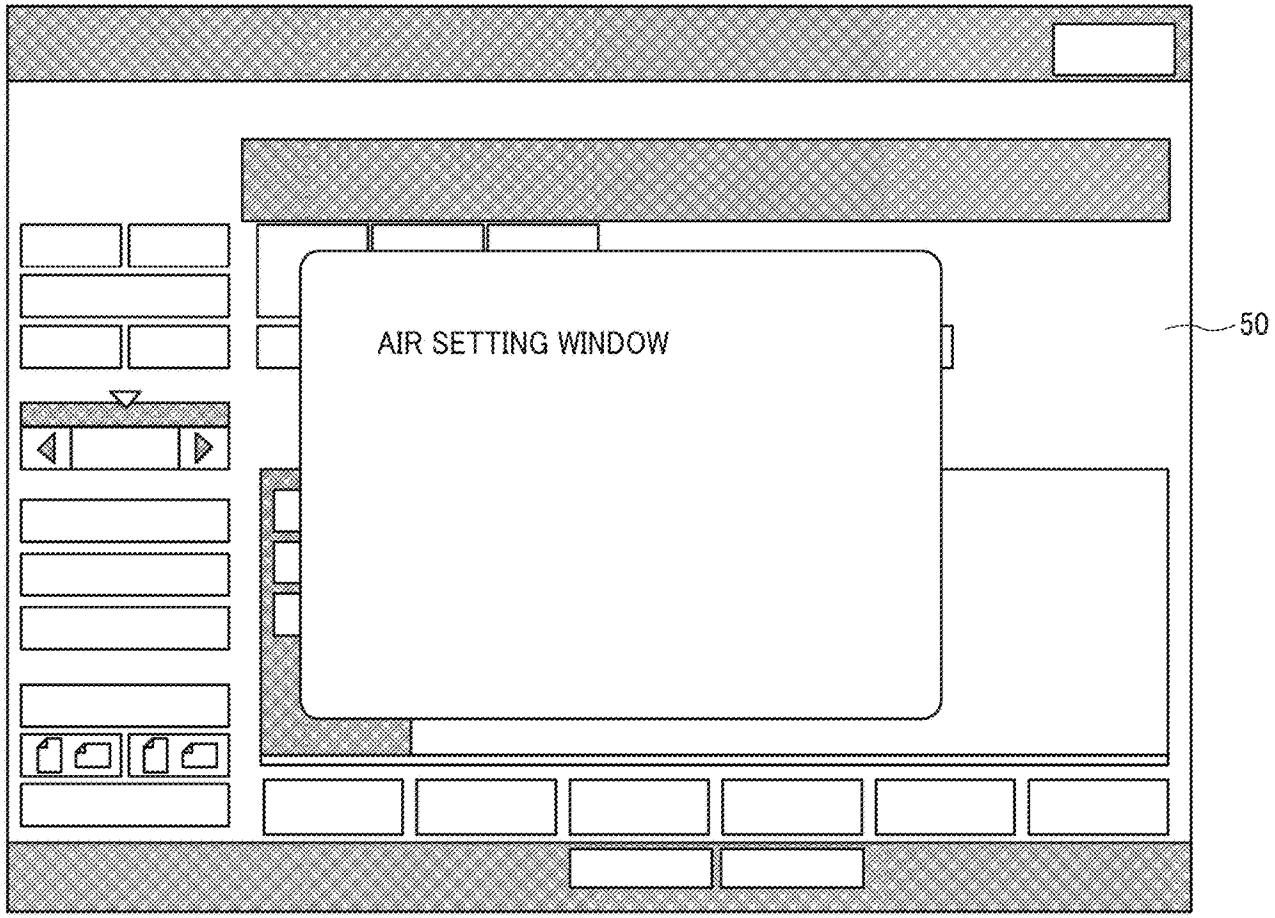
FIG. 20 is a schematic view illustrating an example of a screen displayed on an operation panel according to the present disclosure.

FIG. 20 is a schematic view illustrating an example of a screen displayed on an operation panel. The operation panel 50 may be disposed on the sheet feeding device 200 or the image forming apparatus 100. A setting screen (i.e. window) for the blower 22 and the air suction-and-blowing device 40 is displayed on the operation panel 50. On the setting screen, a user may adjust an air polarity (i.e., positive pressure, negative pressure), an air power and so on.

Figure 21:
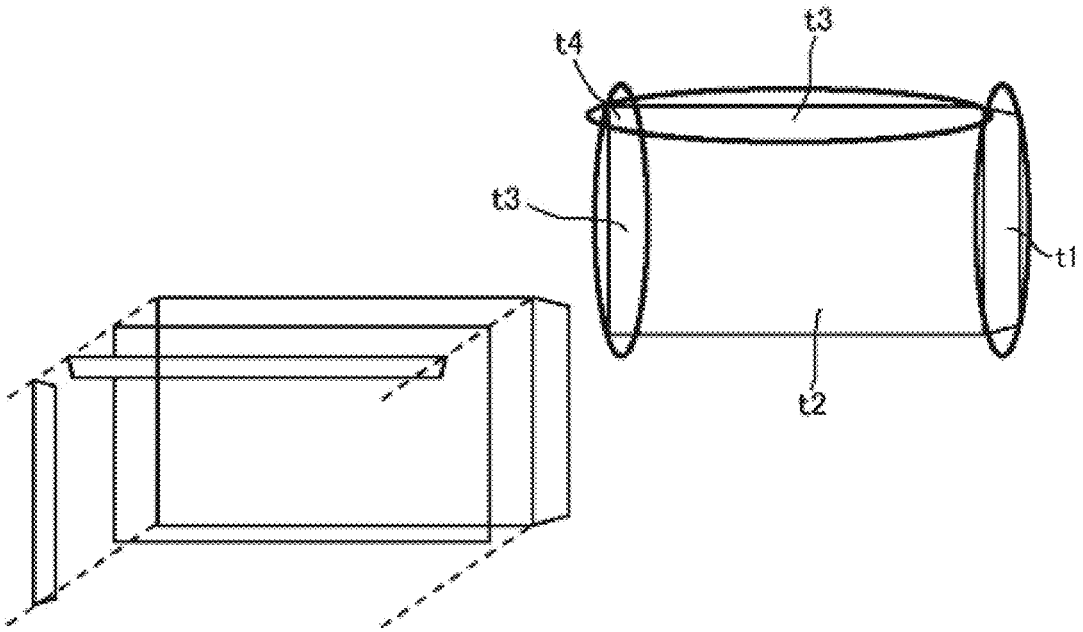
FIG. 21 is a schematic view illustrating an example of a structure of an envelope.

Next, a state in which a large number of envelopes are piled up is explained below. FIG. 21 is a schematic view illustrating an example of a structure of the envelope. In the structure of this envelope, a bottom portion t3 of the envelope consist by three sheets overlapping, and a bottom portion t4 of the envelope consist by four sheets overlapping. Also, a flap portion t1 of the envelope consist of one sheet.

Figure 22:
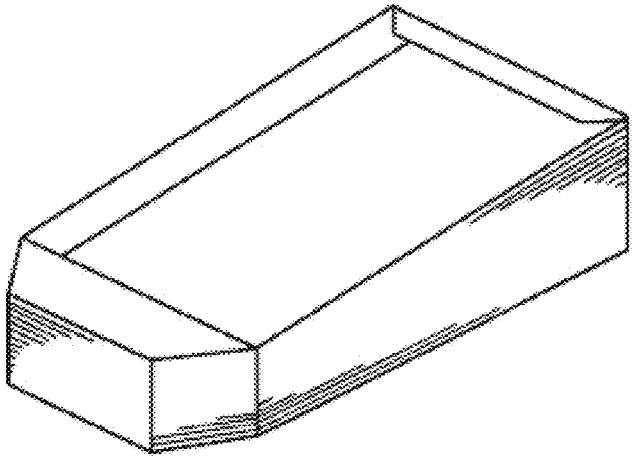
FIG. 22 is a schematic view illustrating an example of a state in which a plurality of envelopes is piled up.

FIG. 22 is a schematic view illustrating an example of a state in which a plurality of envelopes are piled up. In this example, a thickness of a bottom portion of an envelope bundle is larger than that of a flap portion of an envelope bundle.

Figure 23:
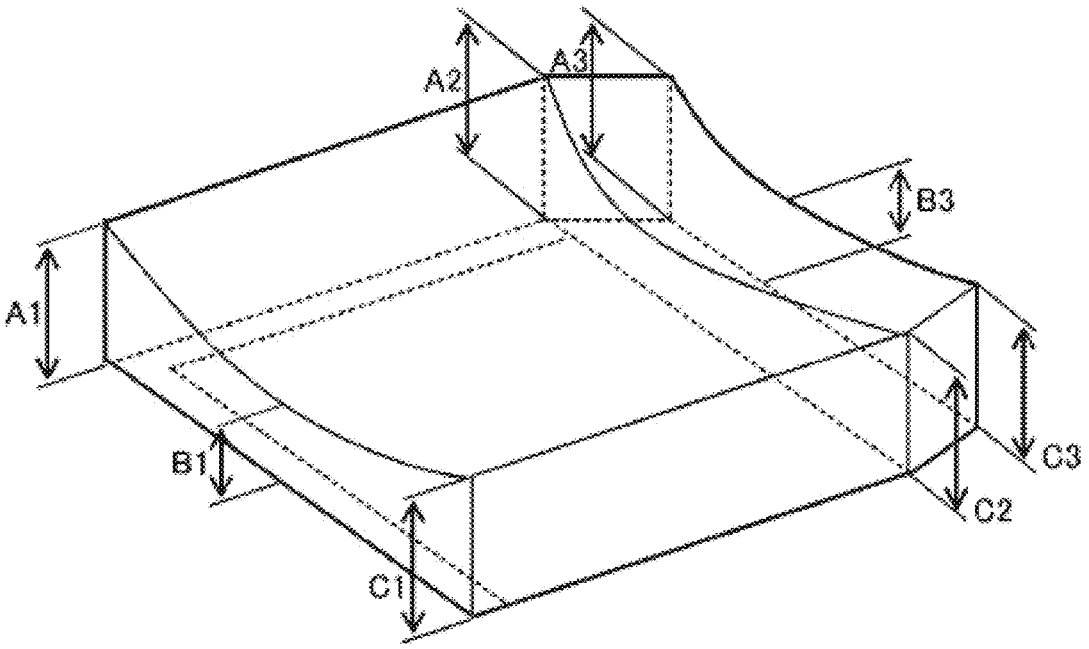
FIG. 23 is a schematic view illustrating another example of a state in which the envelopes are piled up.

FIG. 23 is a schematic view illustrating another example of a state in which the envelopes are piled up. In this example, thicknesses A1, A2, A3, C1, C2, C3 of both sides of an envelope bundle is larger than thicknesses B1 and B3 of a central portion of the envelope bundle.

Figure 24A:
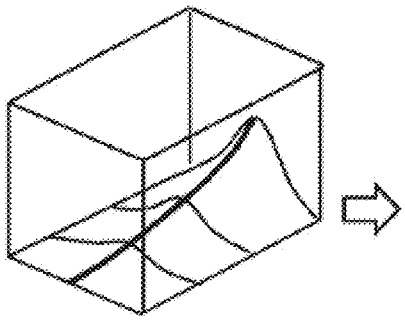
FIG. 24A is a schematic view illustrating an example of a state in which many envelopes are piled up.
Figure 24B:
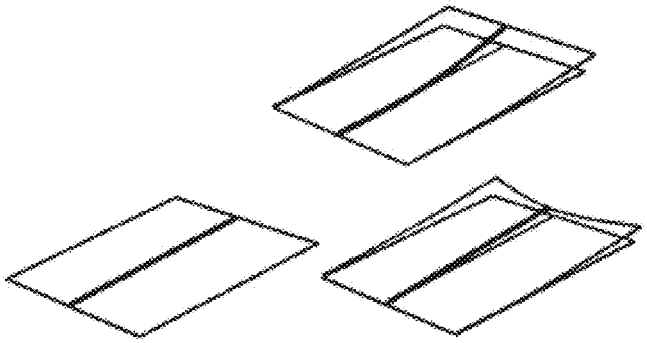
FIG. 24B is a schematic view illustrating an example of a state in which a few envelopes are piled up.

FIG. 24A is a schematic view illustrating an example of a state in which many envelopes are piled up. FIG. 24B is a schematic view illustrating an example of a state in which a few envelopes are piled up.

Numerous additional modifications and variations of the present disclosure are possible in light of the above teachings. It is therefore to be understood that within the scope of the appended claims, the present disclosure may be executed otherwise than as specifically described herein. For example, the printer is not limited to the above-described features and may be altered as appropriate.

What is claimed is:

1. A sheet feeding device, comprising:

a bottom plate configured to move along a vertical axis;

an auxiliary tray disposed on the bottom plate; and a tilt table including:

a lower table disposed on the bottom plate;

an upper table rotatably connected to the lower table at one end of the upper table by a pivot; and a resilient member disposed between the upper table and the lower table, the resilient member configured to press the upper table upward, wherein the auxiliary tray and the upper table are configured to receive and hold sheets in a stack, the sheet feeding device further includes a stopper disposed above the upper table, and another end of the upper table is rotated toward the lower table by contacting the stopper.

2. The sheet feeding device according to claim 1, wherein the bottom plate is configured to move downward along the vertical axis and the other end of the upper table is configured to move downward when sheets are added to the stack, and the bottom plate is configured to move upward along the vertical axis and the other end of the upper table is configured to move upward when sheets are removed from the stack.

3. The sheet feeding device according to claim 1, wherein the upper table is tilted to the auxiliary tray, and an upper surface of a tip portion on a downstream side in a sheet feeding direction of the tilt table is positioned lower than a stacking surface of the auxiliary tray.

4. The sheet feeding device according to claim 1, wherein the auxiliary tray is configured to be engaged with the tilt table.

5. The sheet feeding device according to claim 1, further comprising:

an extension tray is engaged both the auxiliary tray and the tilt table, and is disposed between the auxiliary tray and the tilt table.

6. The sheet feeding device according to claim 5, wherein the extension tray is attached to the bottom plate by an attaching member.

7. The sheet feeding device according to claim 6, wherein the attaching member is an attracting member.

8. The sheet feeding device according to claim 5, further comprising:

a blower to blow an air to the sheets, wherein the extension tray is provided with an air pocket configured to collect the air blown out from the blower.

9. The sheet feeding device according to claim 1, wherein the auxiliary tray is attached to the bottom plate by an attaching member.

10. The sheet feeding device according to claim 9, wherein the attaching member is an attracting member.

11. The sheet feeding device according to claim 1, further comprising:

a blower to blow air to the sheets, wherein the auxiliary tray is provided with an air pocket configured to collect the air blown out from the blower.

12. The sheet feeding device according to claim 1, wherein the resilient member is a spring.

13. The sheet feeding device according to claim 12, wherein the bottom plate is configured to move downward along the vertical axis and the other end of the upper table is configured to move downward when sheets are added to the stack, and the bottom plate is configured to move upward along the vertical axis and the other end of the upper table is configured to move upward when sheets are removed from the stack.

14. The sheet feeding device according to claim 1, wherein the auxiliary tray is configured to hold envelopes in a stack.

15. A sheet feeding device, comprising:

a bottom plate configured to move along a vertical axis;

an auxiliary tray disposed on the bottom plate;

an end fence configured to regulate a rear end of sheets; and a tilt table including:

a lower table disposed on the bottom plate;

an upper table rotatably connected to the lower table at one end of the upper table by a pivot; and a resilient member disposed between the upper table and the lower table, the resilient member configured to press the upper table upward, wherein the auxiliary tray and the upper table are configured to receive and hold the sheets in a stack, and the tilt table is configured to move upward and downward attached to the end fence.

16. The sheet feeding device according to claim 15, further comprising:

a stopper disposed on an upper portion of the end fence, wherein another end of the upper table is rotated toward the lower table by the stopper.

17. The sheet feeding device according to claim 15, wherein the end fence is configured to be detachable from a main body of the sheet feeding device.

18. The sheet feeding device according to claim 15, wherein the tilt table is configured to be detachable from the end fence.

19. An image forming system, comprising:

a printer; and a sheet feeding device comprising:

a bottom plate configured to move along a vertical axis;

an auxiliary tray disposed on the bottom plate; and a tilt table including:

a lower table disposed on the bottom plate;

an upper table rotatably connected to the lower table at one end of the upper table by a pivot; and a resilient member disposed between the upper table and the lower table, the resilient member configured to press the upper table upward, wherein the auxiliary tray and the upper table are configured to receive and hold sheets in a stack, the sheet feeding device further includes a stopper disposed above the upper table, and another end of the upper table is rotated toward the lower table by contacting the stopper.

* * * * *